US005195203A

United States Patent [19]

Blom et al.

[11] Patent Number: 5,195,203

[45] Date of Patent: Mar. 23, 1993

[54] PROCESS FOR DOSING DETERGENT COMPOSITION

[75] Inventors: Johannes J. Blom, Nieuwerkerk a/d IJssel; Marcellus G. Dusamos, Maarssen, both of Netherlands

[73] Assignee: Lever Industrial Company, division of Indopco, Inc., Bridgewater, N.J.

[21] Appl. No.: 760,624

[22] Filed: Sep. 16, 1991

[30] Foreign Application Priority Data

Sep. 18, 1990 [GB] United Kingdom ..... 9020360

[51] Int. Cl.[5] ..... D06F 39/02; A47L 15.44

[52] U.S. Cl. ..... 8/158; 68/17 R; 134/99.2; 222/148; 239/1; 239/112

[58] Field of Search ..... 8/158; 68/17 R; 134/102, 104.1, 99.2, 102.1, 102.2; 222/148; 239/1, 112, 113

[56] References Cited

U.S. PATENT DOCUMENTS 1,528,180 3/1925 Ball ..... 68/17 R X
2,816,427 12/1957 Vela ..... 68/17 R
3,719,191 3/1973 Zimmerly ..... 134/102
4,090,475 5/1978 Kwan ..... 222/148 X

FOREIGN PATENT DOCUMENTS 266199 5/1988 European Pat. Off. .
295525 12/1988 European Pat. Off. .
356707 3/1990 European Pat. Off. .
1150045 4/1969 United Kingdom .
1192442 5/1970 United Kingdom .
1204422 9/1970 United Kingdom .
1549131 7/1979 United Kingdom .
1554560 10/1979 United Kingdom .

*Primary Examiner*—Philip R. Coe
*Attorney, Agent, or Firm*—A. Kate Huffman

[57] ABSTRACT

In a process for dosing detergent compositions, which either are in the form of pastes or gels, or render such compositions when they are brought into contact with water, into a washing machine, the detergent composition is transported from a container for holding the composition to the washing machine via a conduit, whereafter said conduit is purged by means of a pressurized gas, preferably steam or air.

5 Claims, 1 Drawing Sheet

PROCESS FOR DOSING DETERGENT COMPOSITION

Figure 1:
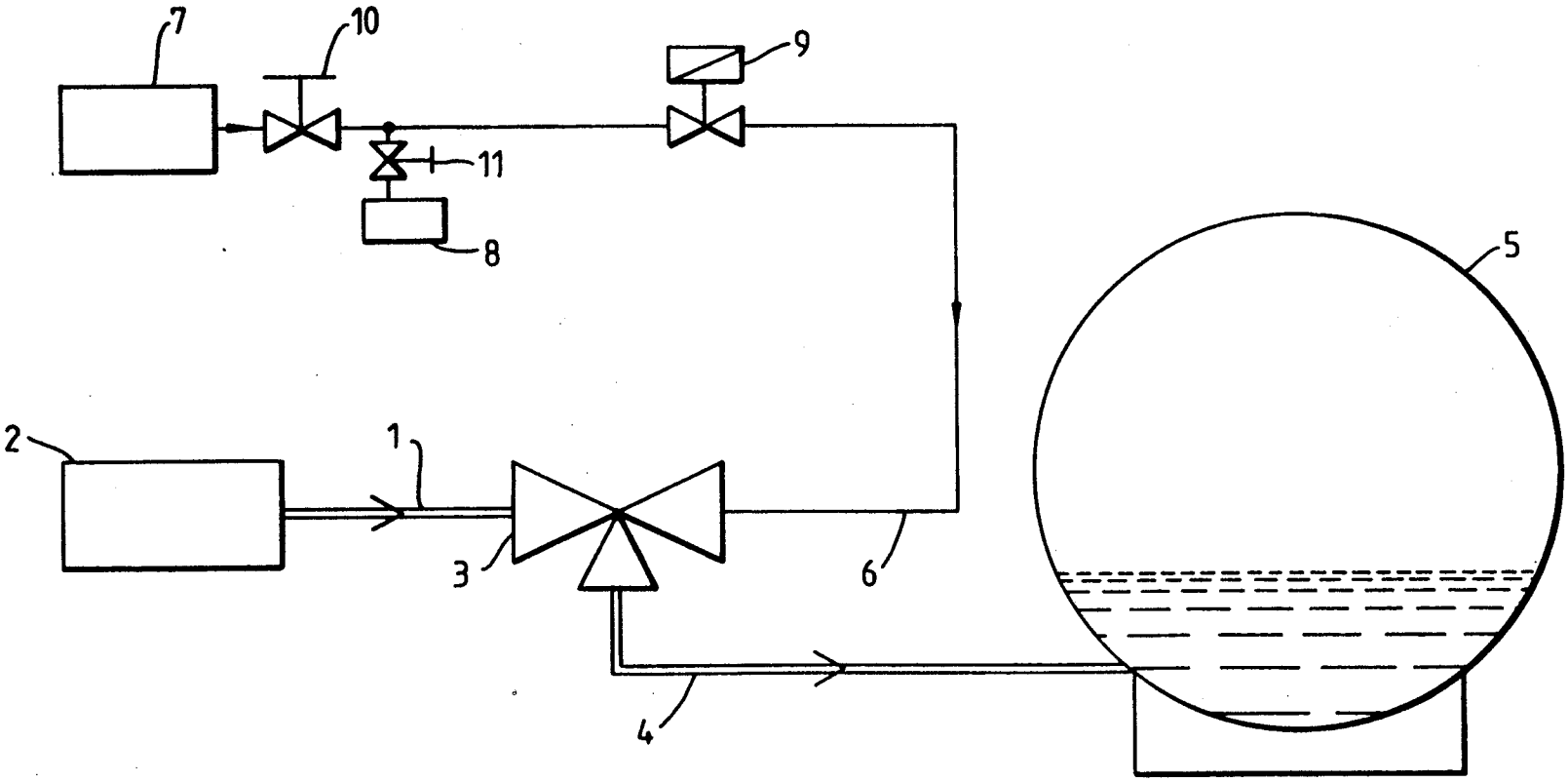

The present invention relates to a process and a device for dosing detergent compositions into a washing machine. More in particular, it relates to a process and a device for dosing detergent compositions which either are in the form of pastes or gels, or render such compositions when they are brought into contact with water.

Detergent compositions in the form of pastes are known in the art, for instance from the U.S. Pat. No. 3,850,831. Moreover, there exist non-aqueous liquid detergent compositions which undergo a drastic viscosity increase upon contact with water, or even form gels. Crystallization of solid components may also occur under such conditions. Examples of such non-aqueous liquid detergent compositions are given in the European patent application 266,199 (Unilever).

Although the above-mentioned pastes or gel-forming liquid detergent compositions may be perfectly satisfactory form a performance point of view, they have not been used extensively so far. Especially in industrial washing machines, such as fabric washing machines or ware washing machines, it was found to be a problem to deliver non-aqueous liquid detergent compositions in a safe and reliable manner into the machine. In such machines, liquid detergent products are conventionally dosed by pumping them from a container via a conduit to the inside of the machine. The water present inside the machine was found to lead to unwanted viscosity increases, phase separation and gel forming of the non-aqueous liquid, whereby the product conduit may clog completely.

The European patent application 356,707 (Henkel) discloses a process for dosing paste-like detergent compositions from a rigid container. The container comprises a hollow cylinder having a movable piston mounted therein, and an opening in the wall opposite to the cylinder, said opening being connected to a conduit which leads to a nozzle inside the dispenser tray of a washing machine. When the piston inside the cylinder is moved towards the opening, the detergent paste is pressed through the nozzle and into the dispenser tray where it is dissolved when water is let in.

The device for dosing the paste-like detergent product in the above process is complex as it comprises a number of movable parts. Furthermore, it appears to be less suitable for dosing products into industrial washing machines whereby the detergent product is dosed directly into the wash liquor without employing a dispenser tray.

It is therefore an object of the present invention to provide a process for dosing detergent compositions which either are in the form of pastes or gels, or render such compositions when they are brought into contact with water, into a washing machine, which process overcomes one or more of the above-mentioned drawbacks. A further object is to provide a device suitable for carrying out said process.

According to a first aspect of the present invention, there is provided a process of the above-mentioned kind, whereby the detergent composition is transported from a container for holding the composition to the washing machine via a conduit, whereafter said conduit is purged by means of a pressurized gas. Preferably, the gas is steam or air.

According to a second aspect of the present invention, there is provided a device for carrying out the process according to the invention, comprising a first conduit for connecting to a container for holding the detergent product, a second conduit for connecting to a washing machine, a third conduit for connecting to a source of pressurized gas, and means to allow either the pressurized gas or the detergent composition to enter the second conduit.

Preferably, these means comprise a three-way valve, which can be operated such that either the detergent composition or the pressurized gas is allowed to flow through the second conduit. More preferably, these means also comprise a magnetic valve located in the third conduit which valve is opened only if the setting of the three-way valve is such that there is an open connection between the second and third conduits so as to prevent the pressurised gas from flowing into the container for holding the detergent product.

It will be understood that the pressurized gas used for purging the conduit leading to the washing machine, is applied for cleaning purposes in order to prevent any blockages from occuring. If this conduit is not purged, these blockages may form as a result of water uptake by the detergent composition.

In practice, we found that conventional steam or pressurized air is very suitable for carrying out the process of the invention. Such pressurized gases are usually already available for other purposes in most industrial washing institutions, so that no special provisions have to be taken. This is considered to be a great advantage of the present invention.

Examples of detergent compositions which can be dosed by means of the process of the invention are the non-aqueous liquids disclosed in the European patent application 266,199 (Unilever).

The invention will now be further explained by means of the accompanying drawing, in which FIG. 1 is a schematic view of the device according to the invention.

FIG. 1 shows a container 2 in which a non-aqueous liquid detergent product is stored. The product is transported by the action of a pump (not shown) from the container via a first conduit 1 to a second conduit 4, which is connected to a washing machine 5. A third conduit 6 is connected at one end via valves 10 and 11 to supply means containing steam 7 respectively pressurised air 8, and at its other end to a three-way valve 3. This three-way valve which is preferably of the ball-valve type, prevents the detergent product from entering the pressurized gas conduit 6, or vice versa. Conduit 6 also comprises a magnetic valve 9. After sufficient product has been pumped into the washing machine, the pumping action is stopped and thereafter the setting of the three-way valve 3 is changed and the magnetic valve 9 is opened for a few seconds, whereby pressurized air or steam is let into the second conduit. The detergent product is thereby blown into the washing machine and the second conduit is thoroughly purged.

We claim:

1. A process for dosing detergent compositions which are rendered in the form of paste or gels upon contact with water comprising:

(a) transporting a detergent composition which is rendered in the form of paste or gel upon contact with water from a container for holding the detergent composition to a washing machine via a conduit; and (b) purging the conduit by means of a pressurized gas to clean the conduit while preventing blockages by the detergent composition.

2. A process according to claim 1, wherein the pressurized gas is steam or air.

3. A process according to claim 1, wherein the transporting step comprises pumping the detergent composition though the conduit.

4. A process according to claim 1, wherein the conduit has an end positioned below a water level inside a washing machine.

5. A process according to claim 4, wherein the conduit end is equipped with one or more nozzles.

* * * * *